United States Patent [19]

Worrallo

[11] 4,368,936

[45] Jan. 18, 1983

[54] GLASS PANEL SUPPORT STRUCTURE

[76] Inventor: Anthony C. Worrallo, 15 Sprott Rd., Kohimarama, Auckland 5, New Zealand

[21] Appl. No.: 308,108

[22] Filed: Oct. 2, 1981

Related U.S. Application Data

[63] Continuation of Ser. No. 176,248, Aug. 7, 1980.

[30] Foreign Application Priority Data

Aug. 8, 1979 [NZ] New Zealand ..... 191240

[51] Int. Cl.[3] ..... A47B 43/00; F16B 12/00

[52] U.S. Cl. ..... 312/257 A; 312/257 SK; 312/140; 312/111; 52/280; 52/288; 403/231

[58] Field of Search ..... 312/257 A, 257 SK, 111, 312/140, 107, 257 R; 52/280, 127, 282, 283, 288; 403/231, 264

[56] References Cited

U.S. PATENT DOCUMENTS

| | | | |
|---|---|---|---|
| 2,559,371 | 7/1951 | Ressinger | 312/140 |
| 2,942,924 | 6/1960 | Stangert | 312/140 |
| 3,370,389 | 2/1968 | Macaluso | 52/282 |
| 3,380,768 | 4/1968 | Wolfensberger | 312/140 |
| 3,477,182 | 11/1969 | Fulton | 312/140 |
| 3,837,128 | 9/1974 | O'Brien | 52/127 |
| 4,034,535 | 7/1977 | Dustmann | 52/280 |
| 4,146,343 | 3/1979 | Worrallo | 403/264 |
| 4,168,922 | 9/1979 | Worrallo | 403/231 |
| 4,207,014 | 6/1980 | Worrallo | 403/264 |

FOREIGN PATENT DOCUMENTS

| | | | |
|---|---|---|---|
| 273515 | 5/1965 | Australia | 52/282 |
| 923965 | 4/1963 | United Kingdom | 52/280 |
| 1274234 | 5/1972 | United Kingdom . | |
| 1302175 | 1/1973 | United Kingdom . | |
| 1329476 | 9/1973 | United Kingdom . | |
| 1366543 | 9/1974 | United Kingdom . | |
| 1378058 | 12/1974 | United Kingdom . | |
| 1392547 | 4/1975 | United Kingdom . | |
| 1417396 | 12/1975 | United Kingdom . | |
| 1482287 | 8/1977 | United Kingdom . | |
| 1540381 | 2/1979 | United Kingdom . | |
| 2037627 | 4/1980 | United Kingdom . | |

*Primary Examiner*—Victor N. Sakran

*Attorney, Agent, or Firm*—Roylance, Abrams, Berdo & Farley

[57] ABSTRACT

Articles of furniture such as showcases, desks, etc. are formed using side and leg members joined at corner structures, the side members defining an opening for receiving a panel, each side member having an elongated, lipped channel which receives a retainer for holding a panel such as a retainer for holding a panel such as a glass pane. Each retainer has a flange portion which is longitudinally slidable into engagement with the lipped channel, a surface which abuts the side member and an upstanding wall to engage the panel edge. In one form the wall has a bent edge to overlie the panel, preventing the panel from being lifted out of the opening in a direction parallel with itself. Interconnection structures and trim strips usable with the structure are also disclosed.

14 Claims, 21 Drawing Figures

GLASS PANEL SUPPORT STRUCTURE

This is a continuation of application Ser. No. 176,248, filed Aug. 7, 1980.

This invention relates to structures for showcases, desks, counters and the like and particularly to arrangements for retaining glass panels in such structures.

BACKGROUND OF THE INVENTION

Showcases and other types of furniture are frequently provided with glass panels and particularly with glass tops and shelves. The present invention involves structural features which are especially useful with showcases and the description herein will therefore be predominantly in connection with such cases.

It can be said that there are two general categories of show or display cases, those which are completely enclosed by glass, usually in combination with other structural and panel materials and to which access is intentionally restricted; and those which have one or more open sides to permit easy access. The first will be referred to as "security" cases, for convenience, although it will be recognized that varying degrees of security can be involved.

In a security case, it is desirable to provide structure which engages the glass panels, particularly tops, in such a way that they cannot readily be dislocated by an unauthorized person but which nevertheless permits easy replacement of damaged panels.

Previously, security glass tops have been installed by welding frames together or by welding retaining corner members to structural members or by gluing the glass in position. These techniques often result in an unattractive structure and do not allow the glass to be easily replaced. Additionally, they are often quite expensive.

BRIEF DESCRIPTION OF THE INVENTION

An object of the present invention is to provide structures which can be used to assemble articles of furniture such as display or show cases having the desired degree of security.

A further object is to provide such structures having glass panels which permits easy replacement of damaged panels without sacrificing security.

Yet another object is to provide such structures which are attractive in appearance and are sturdy and reliable.

A still further object is to provide such structures which can be assembled in a variety of shapes and sizes using similar basic components.

Briefly described, the invention includes an apparatus for supporting and retaining a glass panel comprising a plurality of elongated members each having a substantially flat upper surface, and means defining an elongated recess extending inwardly from the surface, the recess having inwardly protruding lips at both sides; means for supporting said elongated members in a substantially rigid structural relationship with the members defining a closed polygon and with the flat upper surfaces lying in substantially the same plane; a plurality of retainers, at least one for each of said elongated members, each of said retainers including a flanged portion insertable in said elongated recess, a flat portion fixedly attached to said flanged portion and having a surface for lying in contact with the flat upper surface of one of said elongated members, and a retainer wall protruding from the opposite side of said flat portion from said flanged portion for engaging an edge of a glass panel, whereby a panel having a polygonal shape matching the polygon defined by said members can be placed on and retained by the assembly of elongated members and retainers.

In another aspect, the invention includes an article of furniture having a plurality of corners defining an opening to receive a glass panel wherein each of the corner structures includes an elongated leg member having at least two generally orthogonal faces; means defining an elongated outwardly opening lipped channel in each of said faces; first and second elongated side members extending perpendicular to the longitudinal axis of said leg member with an end of each of said side members abutting one of said faces, each of said side members being generally rectangular in cross-section and including means for defining an elongated lipped channel in at least the upper and lower surfaces thereof, and a web interconnecting said channel means, said web having grooves for receiving fasteners in the end thereof for attaching said side member to said leg member; and first and second panel retainers, each of said panel retainers comprising an elongated flange portion longitudinally insertable into the lipped channel in the upper surface of one of said side members, an elongated planar member fixedly attached to said flange portion and having a surface lying in parallel contiguous relationship with the upper surface of said one of said side members when said flange portion is inserted in said channel, and an abutment member extending outwardly from said planar member for contacting an edge of a glass panel.

In order that the manner in which the foregoing and other objects are attained in accordance with the invention can be understood in detail, particularly advantageous embodiments thereof will be described with reference to the accompanying drawings, which form a part of this specification and wherein.

Figure 1A:
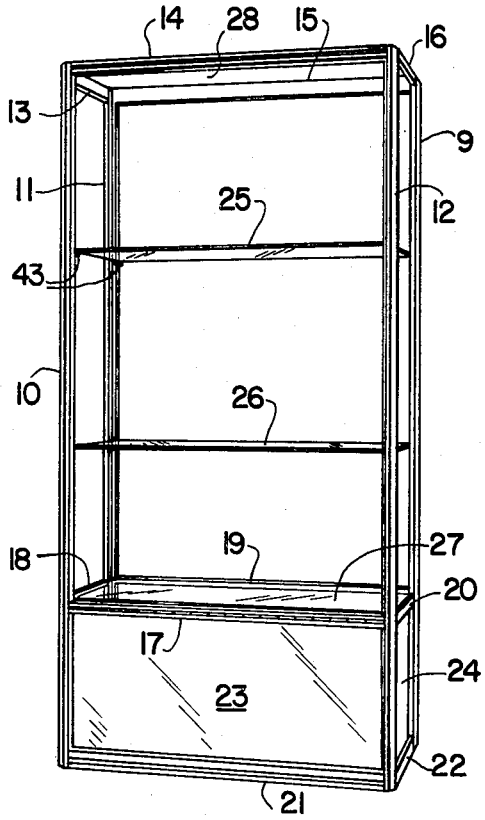
FIGS. 1A, 1B and 1C are perspective views of three different display case structures incorporating the present invention.
Figure 1B:
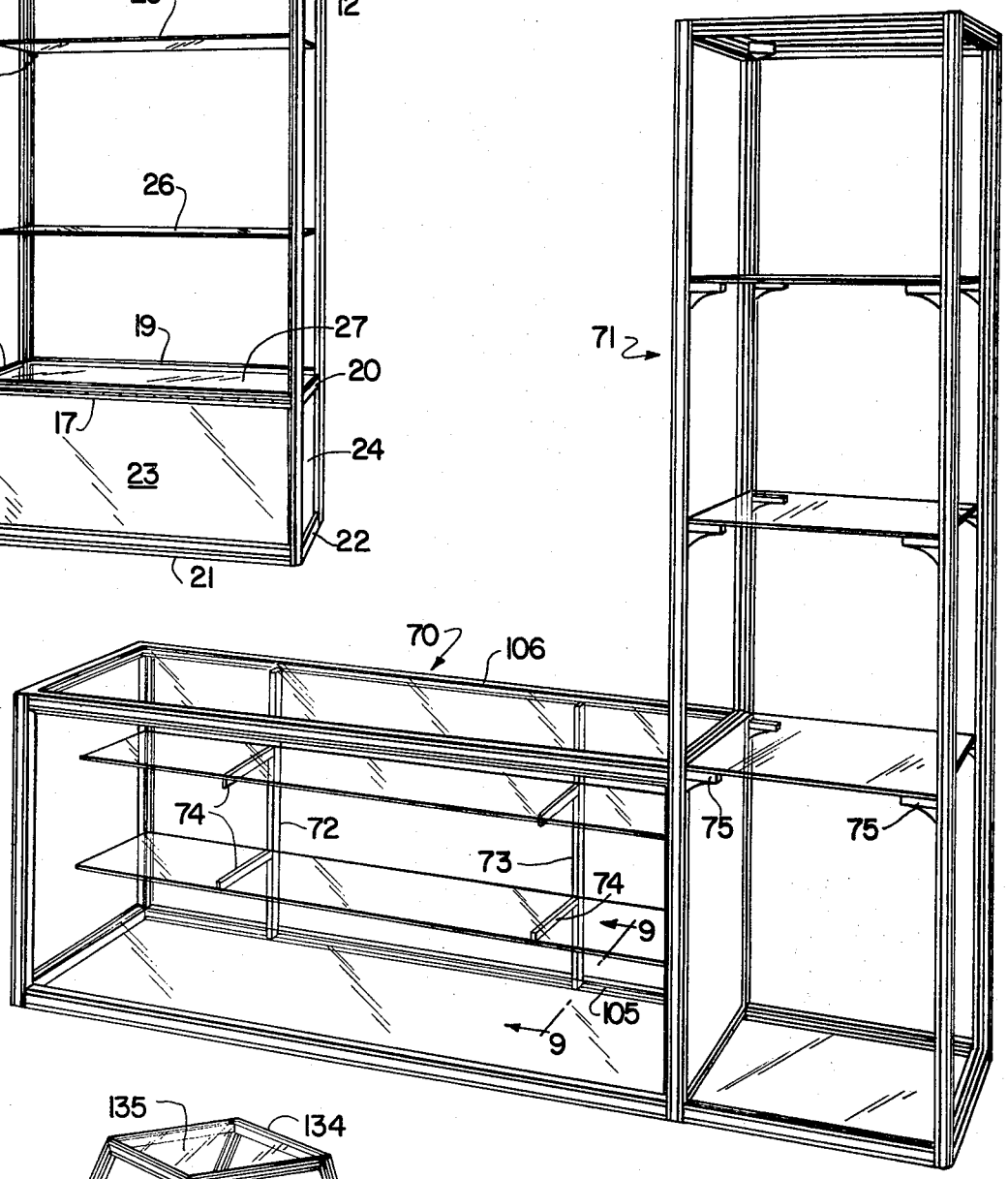
Figure 1C:
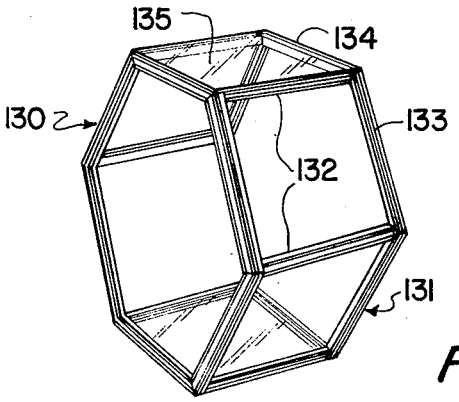

FIGS. 1, 1B and 1C illustrate three different forms of display or showcases which can be constructed employing the principles and structural features of the present invention, and will assist in the understanding of the uses and advantages thereof. FIG. 1A illustrates a showcase of the type intended to provide display of articles and which is commonly constructed to provide easy access to those articles. Thus, the structure includes vertical leg members 9, 10, 11 and 12; horizontal side members 13, 14, 15 and 16 at the top of the leg members; additional side members 17, 18, 19 and 20 near the bottom; and an additional set of side members of which only 21 and 22 are visible in FIG. 1A at the very bottom of the structure. Opaque panels 23 and 24, and similar panels on the remaining two sides, are provided at the bottom. One of these panels can constitute a set of sliding or hinged doors to permit storage of articles for sale. Within the confines of the parallelepiped defined by these members are shelves 25, 26 and 27 on which can be placed articles to be displayed. Normally, shelves 25 and 26 would be transparent, or at least translucent, and shelf 27 would be opaque, or possibly, translucent if bottom lighting is employed.

The details of the structural elements which can be used to form a case of the type shown in FIG. 1A is illustrated in FIGS. 2–5. Of particular interest is the corner structure illustrated in top plan view, partially cut-away, in FIG. 2 and in the sectional view of FIG. 3. As shown therein, the leg indicated generally at 11 includes a leg 30 and a leg 31, the legs having planar surfaces 32 and 33, respectively, which engage in abuting relationship with the contiguous ends of side members 13 and 15.

Because of the fact that the relationship between each leg and the side members attached thereto is the same in each case, only one of the corner structures will be described, that being the top corner structure which has the additional feature of means for retaining a panel of glass 28 which lies across the top of the showcase.

Leg 11 constitutes a metallic extrusion of aluminum or the like and is therefore of uniform cross-section throughout its length. Elongated lipped channels 34 and 35 extend inwardly from surfaces 32 and 33, respectively. The term "lipped channel", which will be repeatedly used herein, refers to a recess of the configuration shown in FIG. 2 which includes inwardly extending lips or flanges such as flanges 36 and 37 which extend toward each other and define a cavity which can be used to retain other elements.

Figure 2:
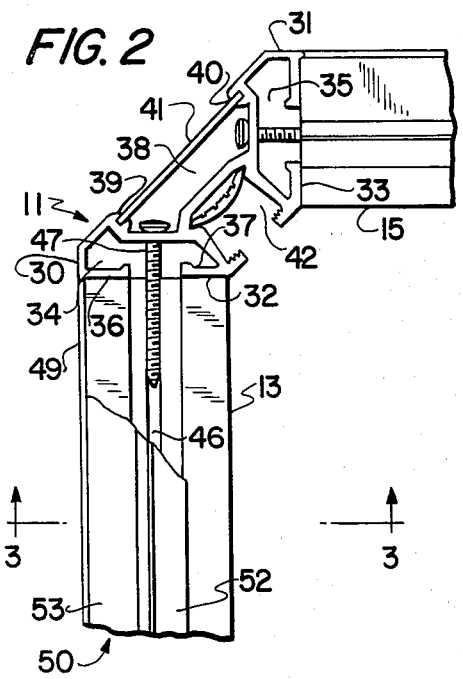
FIG. 2 is a partial top plan view of a top corner structure of a case such as that shown in FIG. 1A.

The outer surface of leg 11 is provided with an elongated recess 38 having grooves 39 and 40 at the opposite sides thereof for receiving a decorative strip 41 which, in the embodiment of FIG. 2, simply constitutes a flat metal strip, the exposed surface of which presents a pleasing appearance. Other decorative elements can be used in place of strip 41.

On the inwardly facing side of leg 11 is a lipped channel 42, the inwardly extending flanges of which are provided with elongated serrations which function to support bracket members or the like, such as brackets 43 in FIG. 1A, for supporting shelves. The specific construction of a support structure for this purpose is shown copending U.S. Patent application Ser. No. 909,264, filed May 24, 1978, by the present inventor, which application is hereby incorporated by reference, and this structure will not be further described herein.

Figure 3:
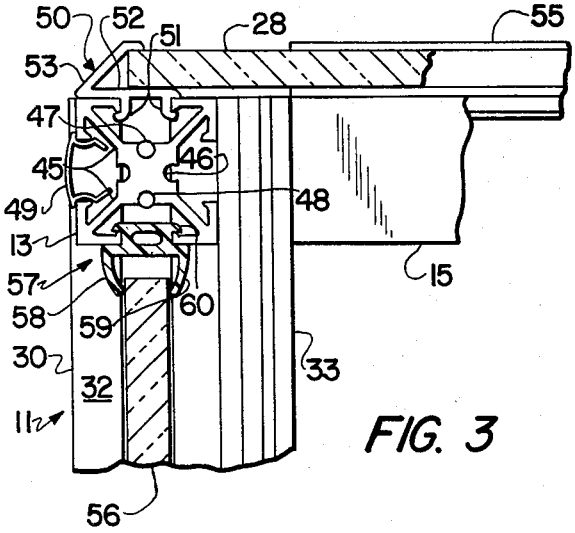
FIG. 3 is a partial side elevation, in partial section, along line 3—3 of FIG. 2.

The cross-sectional configuration of side members 13 and 15 is shown in FIG. 3, these side members being identical in cross-section. It should be noted that all of the side and end members 13–22 shown in FIG. 1A can be identical to each other and of the same cross-section as shown in FIG. 3, the only difference being in length and in the accessory devices used therewith. Thus, only member 13 shown in FIG. 3 will be discussed in detail. As will be seen, the side member 13 is rectangular, and nearly square, in cross-section and is provided with elongated lipped grooves on each face thereof, the corners therefore forming arrow-shaped portions in cross-section. These arrow-shaped corner portions are interconnected by webs 45 which join in a center structure which includes elongated grooves 46 capable of receiving screws extending into the ends of the grooves in a direction parallel with the longitudinal axis of the member. A screw 47 is shown in FIG. 2 penetrating an interior web of leg 11, the head of the screw being in recess 38 and the body of the screw passing through cavity 34 and into the groove of member 13. Although not visible in FIG. 2, a second screw 48 similarly extends from leg 11 into member 13. Thus, side member 13 is rigidly attached to leg 11 and the head of the screw is concealed, after assembly, by insertion of decorative strip 41. As seen in FIG. 3, the outside, exposed lipped channel of member 13 can be provided with a decorative strip 49 which can be an extruded elongated member of resilient polymeric material of any desired color, the member having side recesses formed therein so that it can be simply cut to the proper length and snapped into the lipped channel.

At the top of member 13 is a glass panel retainer 50 which has a flanged portion 51 shaped and dimensioned to engage the lipped channel; a flat portion 52 having a lower surface adapted to lie in parallel contiguous relationship with the upper surface of the side member; and a retaining wall 53 which extends upward from the flat portion in the opposite direction from the flanged portion for the purpose engaging and retaining an edge of glass panel 28. As with the leg and side members, retaining member 50 is an elongated extruded member, which can be made of either a metallic or polymeric material but which is preferably extruded aluminum, having a substantially uniform cross-section throughout its length. In the embodiment shown in FIGS. 2 and 3, the flanged portion includes two downwardly extending legs or walls which hook outwardly, the hooked portions having a transverse dimension which exceeds the distance between the parallel flanges of member 13 defining the lipped channel. Thus, the retaining member can be inserted and removed from member 13 only by longitudinal sliding motion from one end of member 13. The hooked portions prevent separation simply by moving the two members laterally apart.

It will also be observed that the retaining wall in the embodiment shown in FIG. 3 extends diagonally upwardly and inwardly from the outer edge of the flat portion, at an angle of approximately 45°, and terminates in an edge portion bent to extend in a direction parallel with the flat portion, thereby forming a recess having a mouth which can receive the edge of plate 28. As will be recognized, with a rectangular plate 28, and with four retainer members 50 engaging the four edges of the plate, the plate cannot be removed without first removing one of the retainer members. Thus, the plate is securely held and cannot be easily dislocated by one unauthorized to do so. However, if it is necessary to replace plate 28, such replacement can be simply accomplished by removing strip 41 from one of legs 11, removing screws 47 and 48 from member 13, elevating the end of member 13 (or any of the other similar member) slightly so that flanged portion 51 rises above the upper end of leg 11, and then sliding retainer member 50 longitudinally out of the lipped channel which it engages. The plate can then be extracted and a new one inserted, after which the procedure is reversed. It may be necessary, in some cases, to remove the screws from the other leg member 15 if there is not sufficient flexibility to permit lifting the end of leg 13 far enough, but this is not normally necessary.

As also seen in FIGS. 2 and 3, leg member 15 which has a cross-section identical to member 13, is provided with a retainer member 55 which would normally have the same cross-sectional configuration as member 50. Thus, an end view of members 15 and 55 would constitute the mirror image of the view in FIG. 3 of members 13 and 50.

In many showcase constructions, it is also desirable to have a vertically extending panel of transparent or translucent glass or other material or of opaque material, such as panel 23 in FIG. 1A or the front glass panel in the lower portion of the case shown in FIG. 1B. A panel of this general type is illustrated at 56 in FIG. 3, the lateral edges of the panel being received in lipped channel 34 of leg member 11 and in the corresponding channel of leg member 10, the lower edge of the panel resting in the upwardly opening lipped channel of a side member having a cross-section like member 13, e.g., side member 21 in FIG. 1A. The upper edge of panel 51 can then be covered by a gasket member 57 which has downwardly extending side skirts 58 and 59 and an upper flanged portion 60 which is insertable in the lower lipped channel of side member 13. Gasket member 57 is an extruded member of polymeric material selected to be relatively flexible so that it can be snapped into the lipped channel and so that skirt portions 58 and 59 are flexible to adapt to various panel thicknesses. It is intended primarily as a covering member, rather than providing structural support.

Figure 4C:
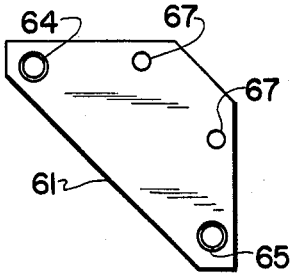
FIGS. 4A, 4B and 4C are top plan, front elevation and bottom plan views of an end cap usable with the structure of FIGS. 2 and 3.
Figure 4A:
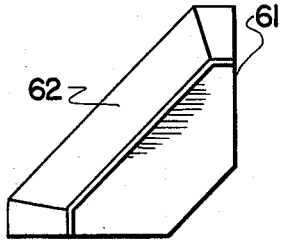
Figure 4B:
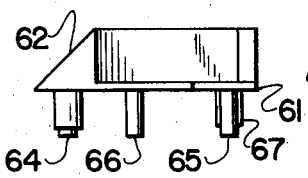

The upper end of leg member 11 is shown, in FIG. 2, as being simply an exposed end of the extruded member, but it is desirable to cover this extruded end to prevent tampering, for cosmetic reasons, and also to cover sharp edges of the extrusion which may be exposed. A cap for this purpose is shown in FIGS. 4A, 4B and 4C and includes a polygonal body 61 having an inclined wall 62 at an angle which generally conforms to the angle of retaining wall 53. The flat portion thereof has a flat bottom surface with downwardly protruding pins 64 and 65 which are positioned in the outer corners of cavities 34 and 35 and smaller pins 66 and 67 which are positioned to be received in the opposite corners of those same cavities. Once inserted, the cap is rather firmly positioned in place, but can be removed for replacement of a glass panel. Cap 61 is preferably a molded polymeric material of a color chosen to match the colors of strip 49 and similar decorative strips.

Figure 5:
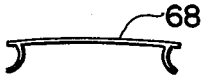
FIG. 5 is a transverse section through a cover strip usable with the structure of FIGS. 2 and 3.

FIG. 5 shows, in cross-section, an extruded polymeric member which can be used in place of strip 41 as a covering piece for the exterior of leg 11. This strip 68 has a generally convex outer surface and hook-edged portions which can be snapped into recesses 39 and 40, the strip being made from an extruded polymeric material having sufficient elasticity and resilience for this purpose.

Figure 6:
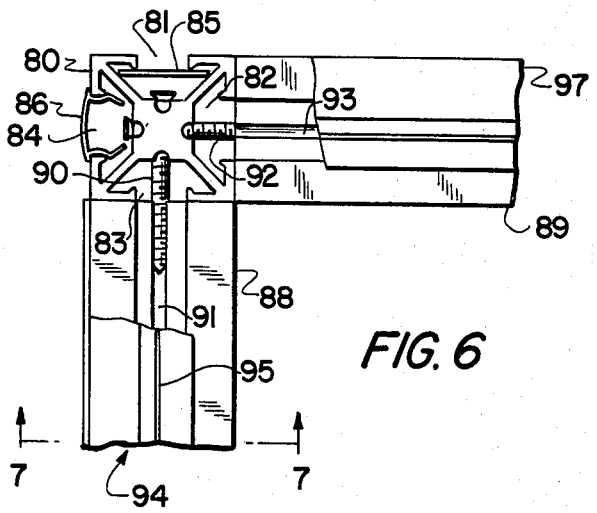
FIG. 6 is a partial top plan view of a top corner structure of a case such as that shown in FIG. 1B.
Figure 7:
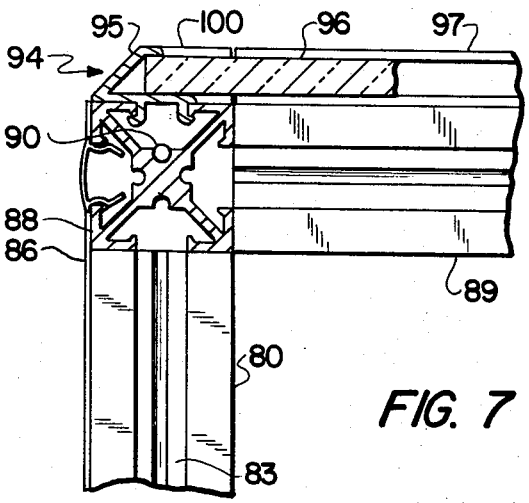
FIG. 7 is a partial side elevation, partially in section, along ine 7—7 of FIG. 6.

FIG. 1B and FIGS. 6 and 7 illustrate a further embodiment of the invention which will now be described. It will be noted that the leg member of FIGS. 1A, 2 and 3, and the other leg members 10, 12 and 19, have diagonal outside corners. The embodiment of FIGS. 1B, 6 and 7 uses a leg member which is identical in cross-section to side member 13 or the embodiment of FIGS. 2 and 3, and also uses side members having that same cross-sectional configuration.

Referring first to FIG. 1B, it will be seen that this display apparatus includes a showcase 70 which is of the usual counter height and a tower portion 71 which is somewhat taller. The two portions are formed as a single unit, but showcase 70 is provided with glass panels or other closures on all sides, whereas tower 71 is glazed at the sides and the top but not at the front and back, thereby permitting access to the articles displayed therein. It will be further observed that both portions are provided with shelf supports, showcase 70 having vertical members 72 and 73 midway across the back to which brackets 74 are attached. The back portion can also be provided with sliding glass doors, to be described. Tower 71 is provided with brackets 75 to support the shelves. The bracket elements themselves do not constitute part of the present invention and will not be described in detail. However, reference is made to U.S. Pat. Nos. 4,146,343, issued Mar. 27, 1979; 4,168,922, issued Sept. 25, 1979; and 4,207,014, issued June 10, 1980, which show support members which are usable and are particularly desirable for use as shelf supports. In particular, brackets 75 can be constructed in accordance with U.S. Pat. No. 4,207,014, permitting infinitely variable adjustment thereof.

Turning now to FIGS. 6 and 7, it will be seen that the structures employed are similar in many respects to those discussed with reference to FIGS. 2 and 3. A corner leg member 80 is of the same cross-sectional configuration as side member 13 and has lipped channels 81, 82, 83 and 84. Channels 81 and 82 are provided with decorative inserts, channel 81 having a flat strip 85 similar to strip 41 of FIG. 2, but, of course, dimensioned to be received in the different sized channel. Channel 84 is provided with a polymeric extruded decorative strip 86 which is substantially identical to strip 49 of FIG. 3.

Leg 80 is firmly attached to side members 88 and 89, which are attached to adjacent orthogonal faces of leg 80. Side member 88 is attached by a screw 90 which passes through a hole drilled for that purpose in the center web structure of leg 80 and into the upper one of the screw-receiving grooves 91 in member 88. Similarly, member 89 is attached by a screw 92 which passes through the center web structure of leg 80, through a hole drilled for that purpose below the hole receiving screw 90, and into the lower one of screw receiving slots 93 in member 89.

As best seen in FIG. 7, the upwardly facing lipped channel of member 88 receives a retainer member indicated generally at 94, member 94 being substantially identical with member 50 of FIGS. 2 and 3, including downwardly and outwardly extending hook-like flange portion, a flat portion, and a retaining wall 95 which has an inwardly extending edge portion parallel with the flat portion thereof to engage the edge of a glass panel 96 placed thereon. The panel has been omitted from FIG. 6 for simplicity.

In a substantially identical fashion side member 89 has a retainer 97 received in the upwardly facing lipped channel thereof, retainer 97 being identical to retainer 94 except, of course, for the length thereof.

Figure 8A:
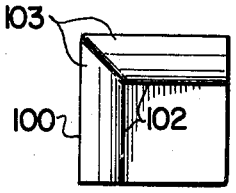
FIGS. 8A, 8B and 8C are top plan, front elevation and bottom plan views, respectively, of an end cap usable with the structure of FIGS. 6 and 7.
Figure 8B:
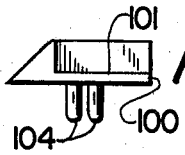
Figure 8C:
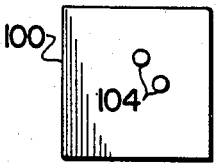

FIGS. 8A-C show a cap 100 designed to be received by, and to cover, the top end of leg member 80. As with the cap 61, cap 100 is molded from a polymeric material and includes a substantially square, flat base portion 101 and an upstanding wall portion 102 along two adjacent edges of the flat portion, the outer surfaces 103 thereof being inclined to conform to the slope of the outer portions of retainers 94 and 97. The bottom of cap 100 is provided with posts or pegs 104 which are located so as to be received in two of the screw-grooves in member 80. The cap is shown in place in FIG. 7, but is omitted from FIG. 6 for clarity.

Figure 9:
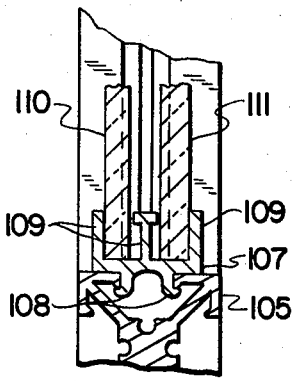
FIG. 9 is a transverse partial sectional view along line 9—9 of FIG. 1B.

FIG. 9 shows a structure which can be employed with a showcase having sliding doors at the back, such as the showcase 70 of FIG. 1B. As seen therein, showcase 70 has a lower rear rail 105 and a similar rail 106 at the top, these rails being side members having a cross-sectional shape identical with the members discussed in connection with FIGS. 6 and 7. In order to provide for sliding glass doors, a plate carrier 107 is mounted in member 105, the carrier having a generally planar flat base portion, flange means 108 protruding downwardly from the bottom of the flat plate in a manner similar to retainers 94, 97, 50 and 55, and three parallel upstanding walls 109 to form two elongated grooves which can receive panels 110 and 111 which can be glass or other material.

Figure 10A:
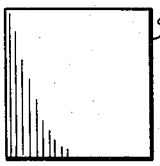
FIGS. 10A, 10B and 10C are top plan, side elevation and bottom plan views of a further embodiment of an end cap in accordance with the invention.
Figure 10B:
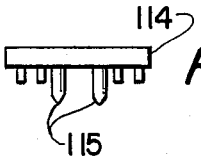
Figure 10C:
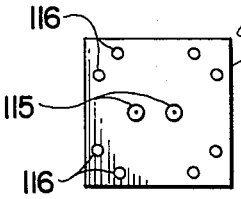

Rail 106, which is a member identical to member 105, can be provided with a similar carrier 107. Thus, the construction of the upper edge of the doors would appear, in section, to be identical to FIG. 9 but inverted 180°. FIGS. 10A, 10B and 10C show a cap designed for use at the end of leg members employing the extrusion shown in FIGS. 6, 7 and 9 and also in FIGS. 2 and 3 as side members. When these extrusions are used as vertical members, it is desirable to apply a covering cap to the lower end thereof to protect a carpet or other surface on which the article can be placed. Similarly, at the upper ends of such legs, in cases where no glass retaining elements are used, it is desirable to cover the ends to avoid contact with sharp edges thereof. As will be seen in FIGS. 10A–C, the cap consists of a square plate 114 having a plane, unadorned surface on one side and a plurality of posts protruding from the other side. Two generally centrally located posts 115 are dimensioned and located to be received in the screw-receiving grooves constituting the central portion of the extrusion, e.g., grooves 91 of member 88. Also provided are pairs of smaller posts 116 adjacent each corner of the square and bracketing diagonals thereof, these posts being located to be inserted on opposite sides of the webs interconnecting the central portion and the corner portions of the extrusion. Thus, once inserted, the end cap is firmly fixed and located.

Figure 11:
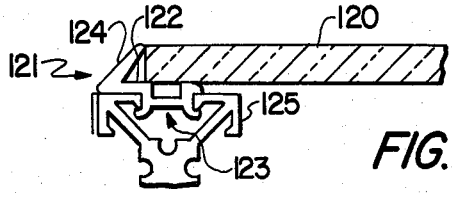
FIG. 11 is a partial side elevation, in section of an alternative embodiment of a structure usable in the embodiments of FIGS. 2, 3, 6 and 7.

FIG. 11 shows an alternative form of retainer element which can be used in place of the retainers illustrated in FIGS. 2, 3, 6 and 7, and is usable in those locations where it is desirable, or at least not objectionable, to be able to simply lift the glass out of the opening formed by the side members. As illustrated therein, the plate 120 rests on a retainer 121 which has a flat portion 122, a flanged portion 123, and a retaining wall 124 which is inclined upwardly and inwardly from the flat portion, but which is smaller than the retaining wall 53, for example, of retainer 50 and has no portion extending parallel with the flat portion. Thus, the retaining wall abuts the edge of plate 120 and prevents lateral movement thereof. As before, the flanged portion engages a lipped channel of a side member 125, the flanged portion in the embodiment illustrated in FIG. 11 having a longitudinal grooved recess extending inwardly from the flat portion and between the hood-shaped flanges thereof.

It will be recognized that the retainer embodiment shown in FIG. 11 can be employed in place of any retainer shown in the other embodiments and might, for example, be used at the top of tower 71 or to retain plate 28 in the display case shown in FIG. 1A. Thus, it does not appear to be necessary to illustrate this embodiment in conjunction with those structures.

Figure 12:
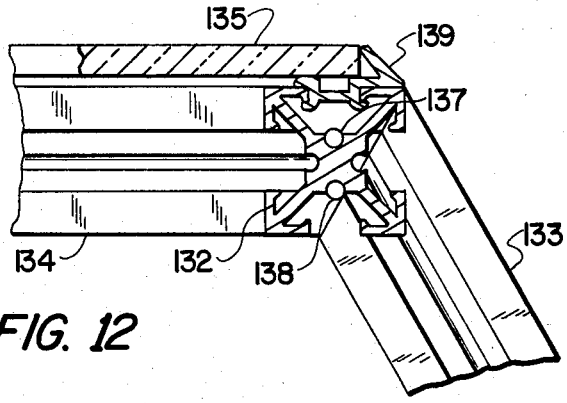
FIG. 12 is a partial front elevation, in section, of a top corner structure for a case such as that shown in FIG. 1C.
Figure 13:
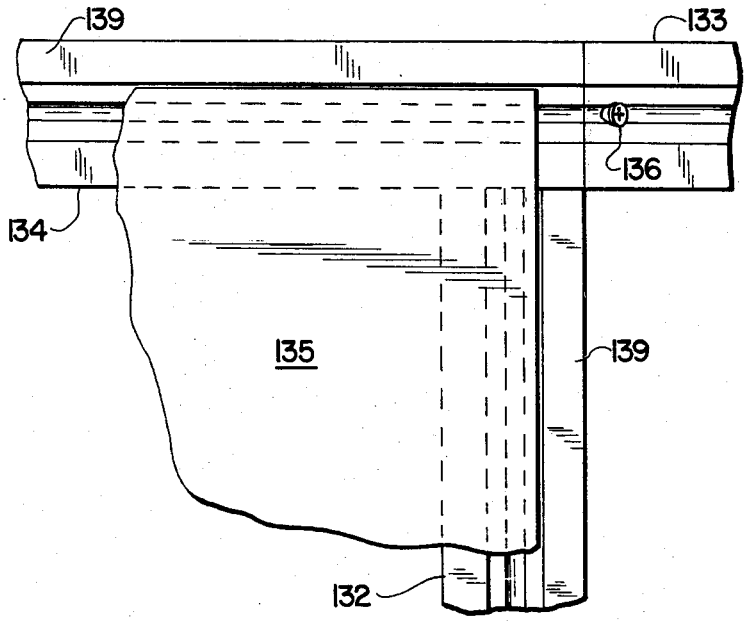
FIG. 13 is a partial top plan view of the structure shown in FIG. 12.

The apparatus of the present invention is, by no means, confined to the construction of retangular showcases, and an embodiment of a showcase illustrating this fact is shown generally in FIG. 1C and a corner structure thereof is shown in FIGS. 12 and 13. Using the same extrusions as discussed in connection with FIGS. 2, 3, 6, 7 and 11, the showcase of FIG. 1C is constructed forming front and rear hexagonal frames, indicated generally at 130 and 131 respectively, these frames being interconnected by six side members 132. The showcase illustrated in FIG. 1C is designed to contain articles at the bottom thereof and to be glazed only at the top so that the top surface can act as a shelf. The other openings in the frame do not contain glass panels, although such panels could be provided, if desired, particularly in the front and rear portions thereof. Thus, the top members forming the substantially square opening at the upper part of the showcase will be considered in detail, and it will be readily apparent from the discussion thereof how the other corner structures can be formed.

The corner structure formed by a side member 132 and frame members 133 and 134 is shown in FIGS. 12 and 13, along with glass panel 135. The contiguous ends of members 133 and 134 are cut at a 60° angle and are joined using a 120° plastic insert or can be joined by inserting a screw 136 penetrating member 133 and extending into one of the screw-receiving grooves in the extrusion forming side member 134. Member 132 is connected directly to member 134 by screws passing through the central web structure of member 134 and into the grooves of member 132, screws 137 and 138 being visible in FIG. 12. Retainers 139 of the type shown in FIG. 11 are inserted in the upper lipped channels of the two side members 132 and also in member 134 and the member parallel and opposite to member 134 defining the square opening to retain plate 135. Decorative strips, not shown, can be inserted as discussed in connection with the preceding figures.

While certain advantageous embodiments have been chosen to illustrate the invention it will be understood by those skilled in the art that various changes and modifications can be made therein without departing from the scope of the invention as defined in the appended claims.

What is claimed is:

1. An apparatus for supporting and retaining a panel comprising a plurality of elongated members each having
a substantially flat upper surface, and
means defining an elongated recess extending inwardly from said surface, said recess having inwardly protruding lips at both sides;

means for supporting said elongated members in a substantially rigid structural relationship with the members defining a closed polygon and with the flat upper surfaces thereof lying in substantially the same plane;

a plurality of retainers, at least one for each of said elongated members, each of said retainers including a flanged portion insertable in said elongated recess, a flat portion fixedly attached to said flanged portion and having a surface for lying in contact with the flat upper surface of one of said elongated members, and a retainer wall protruding from the opposite side of said flat portion from said flanged portion for engaging an edge of a panel, whereby a panel having a polygonal shape matching the polygon defined by said members can be placed on and retained by the assembly of elongated members and retainers.

2. An apparatus according to claim 1 wherein said flat portion and said retainer wall are integrally formed in the shape of a V pointing away from said panel.

3. An apparatus according to claim 2 wherein the distal edge of said retainer wall is bent into a plane parallel with said flat portion to overlie the upper surface of said panel.

4. An apparatus according to claim 3 wherein said flanged portion includes first and second elongated wall portions lying in planes perpendicular to said flat portion, and outwardly extending flanges protruding from the lower, distal edges of said elongated wall portions, the transverse dimension across said flanges exceeding the distance between said lips whereby said flanged portion can be inserted and removed from an elongated member only by longitudinal insertion therein.

5. An apparatus according to claim 1 wherein said flanged portion includes first and second elongated wall portions lying in planes perpendicular to said flat portion, and outwardly extending flanges protruding from the lower, distal edges of said elongated wall portions, the transverse dimension across said flanges exceeding the distance between said lips whereby said flanged portion can be inserted and removed from an elongated member only by longitudinal insertion therein.

6. An apparatus according to claim 1 wherein said means for supporting includes a plurality of leg members, each said leg member including an elongated body of substantially uniform cross-section each said body having first and second faces rigidly disposed in a predetermined angular relationship and lying in planes parallel with the longitudinal axis of the body; and fastener means for attaching ends of said elongated members to said faces of said body.

7. An article of furniture having a plurality of corners defining an opening to receive a panel wherein each of the corner structures includes an elongated leg member having at least two generally orthogonal faces;

means defining an elongated outwardly opening lipped channel in each of said faces;

first and second elongated side members extending perpendicular to the longitudinal axis of said leg member with an end of each of said side members abutting one of said faces, each of said side members being generally rectangular in cross-section and including a substantially flat upper surface lying in the same plane, means defining an elongated lipped channel in said upper surface thereof, and a web having grooves for receiving fasteners in the end thereof for attaching said side member to said leg member; and first and second panel retainers, each of said panel retainers comprising an elongated flange portion longitudinally insertable into the lipper channel in the upper surface of one of said side members, an elongated planar member fixedly attached to said flange portion and having a surface lying in parallel contiguous relationship with the upper surface of said one of said side members when said flange portion is inserted in said channel, and an abutment member extending outwardly from said planar member for contacting an edge of a panel.

8. An apparatus for supporting and retaining a panel comprising a plurality of elongated members each having a substantially flat first surface, and means defining an elongated recess extending inwardly from said surface, said recess having inwardly protruding lips at both sides;

means for supporting said elongated members in a substantially rigid structural relationship with the members definging a closed polygon and with the flat first surfaces thereof lying in substantially the same plane;

a plurality of retainers, at least one for each of said elongated members, each of said retainers including a flanged portion insertable in said elongated recess, a flat portion fixedly attached to said flanged portion and having a surface for lying in contact with the flat first surface of one of said elongated members, and a retainer wall protruding from the opposite side of said flat portion from said flanged portion for engaging an edge of a panel, whereby a panel having a polygonal shape matching the polygon defined by said members can be placed on and retained by the assembly of elongated members and retainers.

9. An apparatus according to claim 8 wherein said flat portion and said retainer wall are integrally formed in the shape of a V pointing away from said panel.

10. An apparatus according to claim 9 wherein the distal edge of said retainer wall is bent into a plane parallel with said flat portion to overlie the first surface of said panel.

11. An apparatus according to claim 10 wherein said flanged portion includes first and second elongated wall portions lying in planes perpendicular to said flat portion, and outwardly extending flanges protruding from the lower, distal edges of said elongated wall portions, the transverse dimension across said flanges exceeding the distance between said lips, whereby said flanged portion can be inserted and removed from an elongated member only by longitudinal insertion therein.

12. An apparatus according to claim 8 wherein said flanged portion includes first and second elongated wall portions lying in planes perpendicular to said flat portion, and outwardly extending flanges portruding from the lower, distal edges of said elongated wall portions, the transverse dimension across said flanges exceeding the distance between said lips, whereby said flanged portion can be inserted and removed from an elongated member only by longitudinal insertion therein.

13. An apparatus according to claim 8 wherein said means for supporting includes a plurality of leg members, each said leg member including an elongated body of substantially uniform cross-section each said body having first and second faces rigidly disposed in a predetermined angular relationship and lying in planes parallel with the longitudinal axis of the body; and fastener means for attaching ends of said elongated members to said faces of said body.

14. An article of furniture having a plurality of corners defining an opening to receive a panel wherein each of the corner structures includes an elongated leg member having at least two generally orthogonal faces;

means defining an elongated outwardly opening lipped channel in each of said faces;

first and second elongated side members extending perpendicular to the longitudinal axis of said leg member with an end of each of said side members abutting one of said faces, each of said side members being generally rectangular in cross-section and including a substantially flat first surface lying in the same plane, means defining an elongated lipped channel in said first surface thereof, and a web having grooves for receiving fasteners in the end thereof for attaching said side member to said leg member; and first and second panel retainers, each of said panel retainers comprising an elongated flange portion longitudinally insertable into the lipped channel in the first surface of one of said side members, an elongated planar member fixedly attached to said flange portion and having a surface lying in parallel contiguous relationship with the first surface of said one of said side members when said flange portion is inserted in said channel, and an abutment member extending outwardly from said planar member for contacting an edge of a panel.

* * * * *